US008384471B2

(12) United States Patent
Yu

(10) Patent No.: US 8,384,471 B2
(45) Date of Patent: Feb. 26, 2013

(54) BIAS CIRCUIT WITH HIGH ENABLEMENT SPEED AND LOW LEAKAGE CURRENT

(75) Inventor: Hung-Chang Yu, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 0 days.

(21) Appl. No.: 12/945,543

(22) Filed: Nov. 12, 2010

(65) Prior Publication Data

US 2012/0119823 A1 May 17, 2012

(51) Int. Cl.
*G05F 3/26* (2006.01)
*G05F 3/24* (2006.01)

(52) U.S. Cl. ..... 327/543; 327/541; 323/313; 323/315

(58) Field of Classification Search ..... None
See application file for complete search history.

(56) References Cited

U.S. PATENT DOCUMENTS 5,304,861 A * 4/1994 Fruhauf et al. ..... 327/514
6,624,671 B2 * 9/2003 Fotouhi ..... 327/112
7,348,833 B2 * 3/2008 Fujimoto ..... 327/538
7,495,507 B2 * 2/2009 Choi ..... 327/543
2006/0091939 A1 * 5/2006 Do et al. ..... 327/543

OTHER PUBLICATIONS

Razavi, B., "Design of Analog CMOS Integrated Circuits," McGraw-Hill International Edition, Electrical Engineering Series, ISBN-0-07-118815-0; 2001 (p. 381).

* cited by examiner

*Primary Examiner* — Lincoln Donovan
*Assistant Examiner* — Terry L Englund
(74) *Attorney, Agent, or Firm* — Slater & Matsil, L.L.P.

(57) ABSTRACT

A circuit includes a first PMOS transistor and a second PMOS transistor, wherein a gate of the second PMOS transistor is coupled to a gate and a drain of the first PMOS transistor; a first NMOS transistor having a drain coupled to a drain of the first PMOS transistor; and a second NMOS transistor, wherein a drain of the second NMOS transistor is coupled to a gate of the first NMOS transistor, a gate of the second NMOS transistor, and a drain of the second PMOS transistor. A first switch is coupled between the drain of the first PMOS transistor and the drain of the second PMOS transistor. A second switch is coupled between a source of the first NMOS transistor and an electrical ground. A third switch is coupled between a source of the second NMOS transistor and the electrical ground.

19 Claims, 2 Drawing Sheets

BIAS CIRCUIT WITH HIGH ENABLEMENT SPEED AND LOW LEAKAGE CURRENT

BACKGROUND

Bias circuits are used to provide bias voltages, which may be used to bias PMOS and NMOS transistors. The bias circuits provide the bias voltages when they are enabled by enablement signals. There are various types of bias circuits with different designs.

One of the commonly used bias circuits includes a series of diodes, which may be formed of transistors with the gates connected to the respective drains. The series of diode connected devices are used to start up the bias circuit that usually has a pair of PMOS and/or NMOS transistors forming a current mirror. For these diode-connected types of bias circuits, there is a serious trade-off between leakage current and enablement speed. To enhance enablement speed, short channel diode-connected device is preferable; on the other hand to prevent leakage current from flowing through the diodes, it is desirable to use long channel transistors to form the diodes, and/or to increase the number of the serially connected diodes. However, this causes a reduction in the turn-on speed of the transistors that form the current mirror, and a reduction in the enablement speed of the bias circuit. Conversely, if short channel transistors are used, although the enablement speed is increased, the leakage current increases either. Furthermore, the rising in VCC voltages, which are the power supply voltages of the bias circuits, may also result in the increase in the leakage currents. Typically, these types of bias circuits have very low enablement speed, often in the order of micro-seconds.

In a second conventional bias circuit, an NMOS transistor and a PMOS transistor are inserted into the two signal paths of a current mirror of a bias circuit. The gate of the NMOS transistor is connected to VCC, and the gate of the PMOS transistor is connected to an electrical ground. The other NMOS transistor and the PMOS transistor help to balance loading and the layout pattern to avoid mismatch issues. Typically, this type of bias circuits has a very high enablement speed, often in the order of tens of nano-seconds. However, this type of bias circuits is prone to the disturbance from the power supply, which disturbance is coupled from the VCC and the electrical ground to the gates of the NMOS transistor and the PMOS transistor. Accordingly, the disturbance is adversely coupled into the signal paths.

BRIEF DESCRIPTION OF THE DRAWINGS

For a more complete understanding of the embodiments, and the advantages thereof, reference is now made to the following descriptions taken in conjunction with the accompanying drawings, in which.

DETAILED DESCRIPTION OF ILLUSTRATIVE EMBODIMENTS

The making and using of the embodiments of the disclosure are discussed in detail below. It should be appreciated, however, that the embodiments provide many applicable inventive concepts that can be embodied in a wide variety of specific contexts. The specific embodiments discussed are merely illustrative, and do not limit the scope of the disclosure.

A novel bias circuit with a high enablement speed and a low leakage current is presented in accordance with an embodiment. The variations and the operation of the embodiment are then discussed. Throughout the various views and illustrative embodiments, like reference numbers are used to designate like elements.

Figure 1:
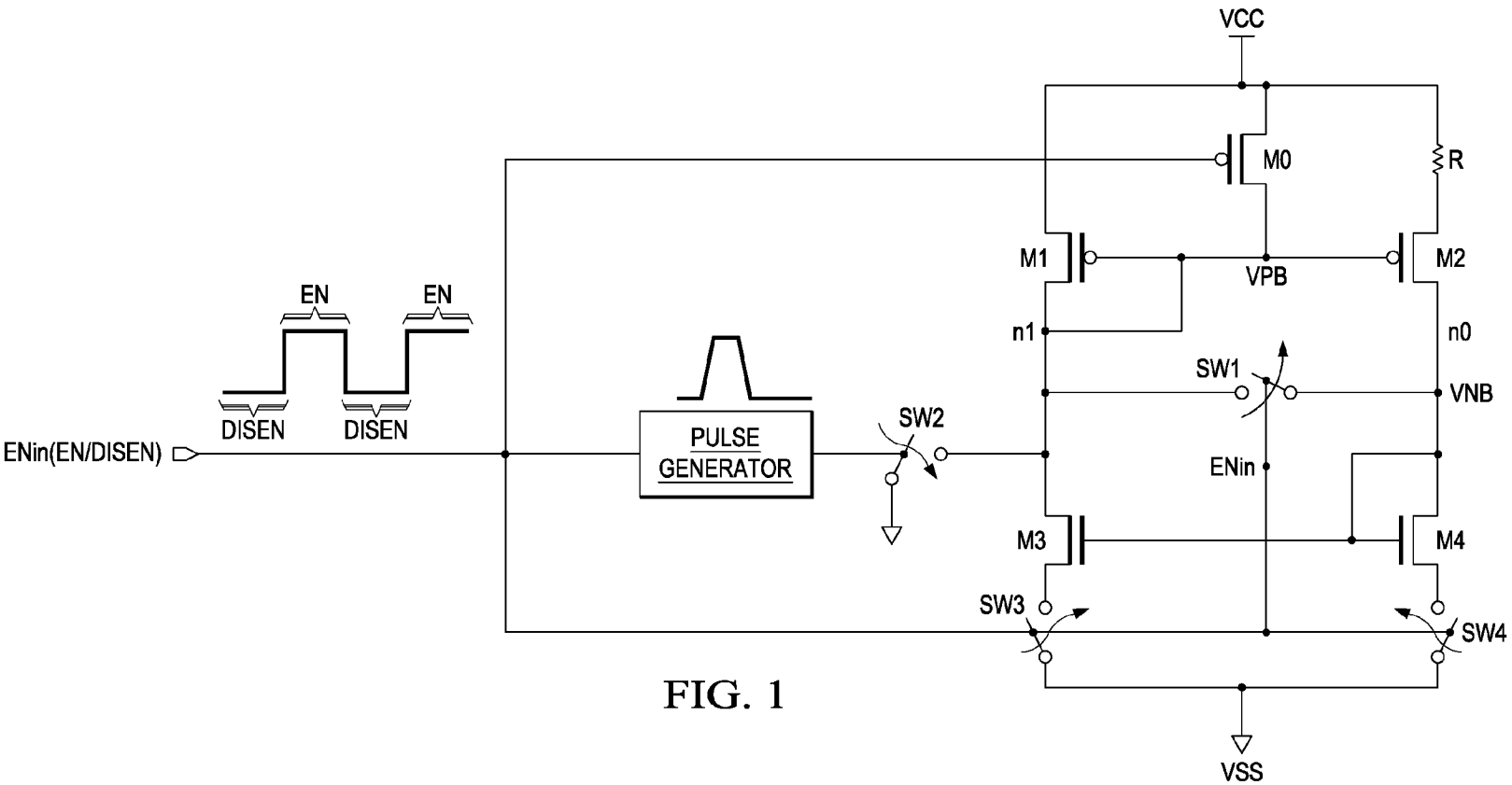
FIG. 1 illustrates a schematic circuit diagram of a new architecture of a fast enablement circuit.

FIG. 1 illustrates a circuit diagram of a bias circuit in accordance with an embodiment. The bias circuit includes PMOS transistors M1 and M2 forming a current mirror, wherein the gate and the drain of PMOS transistor M1 are coupled together, and are further coupled to or directly connected to the gate of PMOS transistor M2. NMOS transistors M3 and M4 form a current mirror, wherein the gate and the drain of NMOS transistor M4 are coupled together, and are further coupled to the gate of NMOS transistor M3. PMOS transistor M0 has its source coupled to a positive power supply node VCC, which receives a positive power supply voltage (also denoted as VCC) from a power supply circuit (not shown). The drain of PMOS transistor M0 is coupled to the gates of PMOS transistors M1 and M2. The gate of PMOS transistor M0 is coupled to an enablement signal node ENin, which receives enablement signal EN and disablement signal DISEN. In the illustrated embodiment, enablement signal EN is a logic high signal, and disablement signal DISEN is a logic low signal. Resistor R is coupled between positive power supply node VCC and the source of PMOS transistor M2, and may be directly connected to positive power supply node VCC and the source of PMOS transistor M2.

Switch SW1 is coupled between node n1, which are also coupled to the gate/drain of PMOS transistor M1, and node n0, which is coupled to the drain of PMOS transistor M2. Accordingly, switch SW1 is configured to connect the gates of PMOS transistors M1 and M2 to the gates of NMOS transistors M3 and M4, and to disconnect the gates of PMOS transistors M1 and M2 from the gates of NMOS transistors M3 and M4. Furthermore, Switch W1 switch SW1 is controlled by the signal received from enablement signal node ENin.

Switch SW2 is coupled between node n1 and power supply node VSS, which may be the electrical ground. Switch SW2 is coupled to an output of a pulse generator, and is controlled by an output signal of the pulse generator. The input of the pulse generator is coupled to enablement signal node ENin. The pulse generator generates a short pulse after enablement signal EN is received at its input. The pulse causes switch SW2 to be at a closed state. After the short pulse is finished, the pulse generator outputs a signal to keep switch SW2 at an opened state. Further, for an entire duration of an enablement signal EN, there may only be one pulse generated by the pulse generator. In other words, after the pulse is generated, the pulse generator does not generate any other pulse until it receives another disablement signal DISEN followed by another enablement signal EN.

Switches SW3 and SW4 couple the sources of NMOS transistors M3 and M4, respectively, to electrical ground VSS. The control nodes of switches SW3 and SW4 are coupled to enablement signal node ENin. Since switches SW1, SW3, and SW4 are all coupled to and controlled by the same enablement/disablement signals, they work in a synchronous mode. Further, the phases of switch SW1 are opposite to phases of switches SW3 and SW4, that is, when switch SW1 is closed, switches SW3 and SW4 are opened, and when switch SW1 is opened, switches SW3 and SW4 are closed. Throughout the description, the signal path comprising PMOS transistor M1, NMOS transistor M3, and switch SW3 is referred to as a first signal path, and the signal path comprising PMOS transistor M2, NMOS transistor M4, and switch SW4 is referred to as a second signal path.

An operation of the bias circuit as shown in FIG. 1 is briefly discussed as follows. Before the enablement of the bias circuit, enablement signal node ENin receives disablement signal DISEN, which is a logic low signal in the illustrated embodiment. PMOS transistor M0 is thus turned on, and hence node n1 is pre-charged to power supply voltage VCC through PMOS transistor M0. Switch SW1, which is also coupled to or directly connected to enablement signal node ENin, is at a closed state. Accordingly, nodes n1 and n0, which are also coupled to the drains of NMOS transistors M3 and M4, are equalized and pre-charged to power supply voltage VCC. Accordingly, through switch SW1, and further through the connected gate and drain of NMOS transistor M4, the gates of NMOS transistors M3 and M4 are also pre-charged to power supply voltage VCC.

During the period the disablement signal DISEN is applied on enablement signal node ENin, switches SW3 and SW4 are opened, and hence the sources of NMOS transistors M3 and M4 are disconnected from electrical ground VSS. Accordingly, no leakage currents flow through the first and the second signal paths. In addition, switch SW2 is opened, so that node n1 is disconnected from electrical ground VSS.

When enablement signal EN is applied on enablement signal node ENin to enable the bias circuit, PMOS transistor M0 is turned off to disconnect positive power supply node VCC from node n1. At this time, since the gates of NMOS transistors M3 and M4 have already been pre-charged to power supply voltage VCC, NMOS transistors M3 and M4 are turned on. PMOS transistors M1 and M2 are initially turned off since their gate voltages are also pre-charged to voltage VCC.

When enablement signal EN, which is a logic high signal, is received by the pulse generator, a short pulse is generated, during which switch SW2 is turned on to couple node n1 to electrical ground VSS. Accordingly, the gate voltages of PMOS transistors M1 and M2 are rapidly pulled down, and PMOS transistors M1 and M2 are turned on rapidly. The duration of the short pulse outputted by the pulse generator is configured to allow PMOS transistors M1 and M2 to be at least partially, and may be fully, turned on, and then the pulse is ended, and switch SW2 is opened again.

When enablement signal EN, which may be a logic high signal, causes switches SW3 and SW4 to be closed, currents flow through the first and the second signal paths through transistors M1, M2, M3, and M4. The interaction of transistors M1, M2, M3, and M4, and resistor R results in the bias circuit to enter a steady state, and bias voltages VPB and VNB may be outputted from output nodes n1 and n0, respectively. In an embodiment, output voltages VPB and VNB may be about 0.5V and 0.9V, respectively, for example. It is realized, however, that these output voltages are merely examples, and may be different when the parameters of the bias circuit are adjusted.

Figure 2:
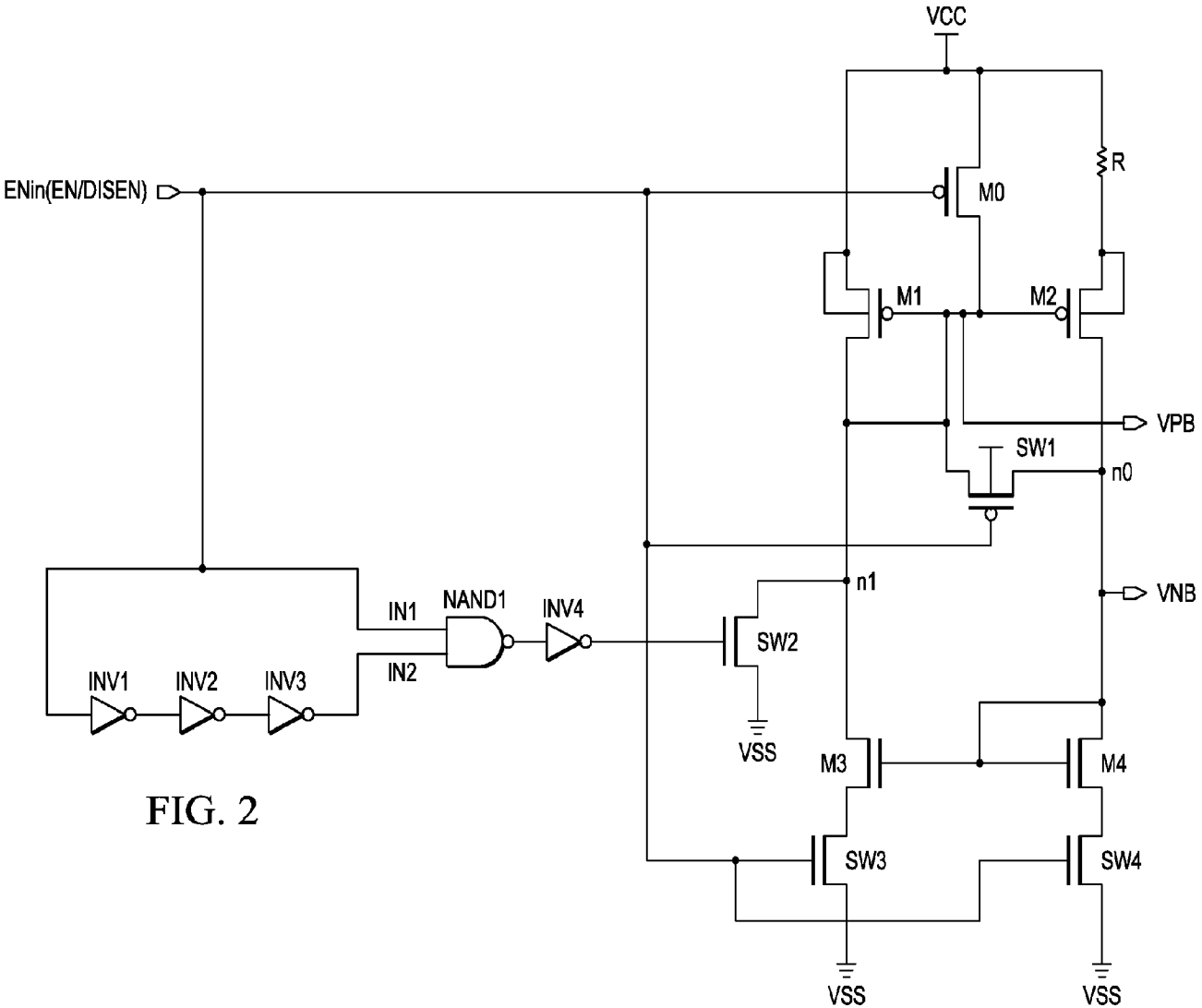
FIG. 2 illustrates an exemplary implementation of the fast enablement circuit used in the bias circuit as shown in FIG. 1.

FIG. 2 illustrates a circuit implementing the circuit shown in FIG. 1. In this implementation, switch SW1 comprises a PMOS transistor. Each of switches SW2, SW3, and SW4 comprises an NMOS transistor, and the gates of the NMOS transistors are coupled to, and may be connected directly to, enablement signal node ENin. Accordingly, the gates of transistors SW1, SW2, SW3, and SW4 are the control nodes of the respective switches. The pulse generator may comprise inverters INV1, INV2, INV3, INV4, and NAND gate NAND1. When enablement signal node ENin receives disablement signal DISEN, NAND gate NAND1 outputs a logic high signal, and inverter INV4 outputs a logic low signal, so that switch SW2 is turned off.

After enablement signal node ENin receives enablement signal EN, input IN1 of NAND gate NAND1 receives a logic high voltage. Initially, the input IN2 of NAND gate NAND has a logic high voltage, and hence NAND gate NAND1 outputs a logic low signal, and inverter INV4 outputs a logic high signal, so that switch SW2 is turned on. When the enablement signal EN passes through inverters INV1, INV2, and INV3, and the resulting logic low signal reaches input IN2 of NAND gate NAND1, the short pulse ends, and inverter INV4 outputs a logic low signal again. Therefore, the duration of the pulse generated by the pulse generator is close to the total delay time of inverters INV1, INV2, and INV3. Accordingly, by changing the configuration and/or the number of the serially coupled inverters, the duration of the short pulse generated by the pulse generator may be adjusted. The count of the serially coupled inverters may be an odd number.

In the embodiment, switch SW1 is used to pre-charge the gates of NMOS transistors M3 and M4, so that the enablement speed is increased. Switch SW2 helps quickly pull down the gate voltages of PMOS transistors M1 and M2, and hence the bias circuit may enter the steady state quickly. Simulation results revealed that the enablement of the bias circuits in accordance with embodiments may be as fast as about 5 nano-seconds. Further, switches SW3 and SW4 disconnect the first and the second signal paths when the bias circuit is not enabled. Accordingly, there is no leakage current when the bias circuit is not enabled. In addition, the inherent source-to-drain resistances of switches SW3 and SW4 make bias currents more linear, which currents flow through the source-drain paths of PMOS transistors M1 and M2.

In accordance with embodiments, a circuit includes a first and a second PMOS transistor, wherein a gate of the second PMOS transistor is coupled to a gate and a drain of the first PMOS transistor; a first NMOS transistor having a drain coupled to a drain of the first PMOS transistor; and a second NMOS transistor, wherein a drain of the second NMOS transistor is coupled to a gate of the first NMOS transistor, a gate of the second NMOS transistor, and a drain of the second PMOS transistor. A first switch is coupled between, and configured to equalize, the drain of the first PMOS transistor and the drain of the second PMOS transistor. A second switch is coupled between a source of the first NMOS transistor and an electrical ground. A third switch is coupled between a source of the second NMOS transistor and the electrical ground, wherein the second and the third switches are configured to operate with phases opposite to phases of the first switch.

In accordance with other embodiments, a circuit includes a first and a second signal path. The first signal path includes a first PMOS transistor; a first NMOS transistor; and a first switch, wherein the first switch, a source-drain path of the first PMOS transistor, and a source-drain path of the first NMOS transistor are serially coupled between a positive power supply node and an electrical ground. The second signal path includes a second PMOS transistor; a second NMOS transistor; and a second switch, wherein the second switch, a source-drain path of the second PMOS transistor, and a source-drain path of the second NMOS transistor are serially coupled between the positive power supply node and the electrical ground. A third switch is configured to interconnect gates of the first and the second PMOS transistors and gates of the first and the second NMOS transistors, and to disconnect the gates of the first and the second PMOS transistors from the gates of the first and the second NMOS transistors. A fourth switch is configured to interconnect the gates of the first and the second PMOS transistor to the electrical ground, and disconnect the gates of the first and the second PMOS transistor from the electrical ground.

In accordance with yet other embodiments, in a method of generating bias voltage, a bias circuit is provided. The bias circuit includes a first PMOS transistor; a second PMOS transistor, wherein a gate of the second PMOS transistor is coupled to a gate and a drain of the first PMOS transistor; a first NMOS transistor having a drain coupled to a drain of the first PMOS transistor; and a second NMOS transistor. A drain of the second NMOS transistor is coupled to a gate of the first NMOS transistor, a gate of the second NMOS transistor, and a drain of the second PMOS transistor. The method includes, in response to a disablement signal on an enablement signal node, equalizing gate voltages of the first and the second PMOS transistors and gate voltages of the first and the second NMOS transistors to a positive power supply voltage, and disconnecting sources of the first and the second NMOS transistors from an electrical ground. The method further includes, in response to an enablement signal on the enablement signal node, disconnecting the gates of the first and the second PMOS transistors from the gates of the first and the second NMOS transistors, and connecting the sources of the first and the second NMOS transistors to the electrical ground.

Although the embodiments and their advantages have been described in detail, it should be understood that various changes, substitutions and alterations can be made herein without departing from the spirit and scope of the embodiments as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure, processes, machines, manufacture, compositions of matter, means, methods, or steps, presently existing or later to be developed, that perform substantially the same function or achieve substantially the same result as the corresponding embodiments described herein may be utilized according to the disclosure. Accordingly, the appended claims are intended to include within their scope such processes, machines, manufacture, compositions of matter, means, methods, or steps. In addition, each claim constitutes a separate embodiment, and the combination of various claims and embodiments are within the scope of the disclosure.

What is claimed is:

1. A circuit comprising:

a first current mirror comprising:

a first PMOS transistor; and a second PMOS transistor, wherein a gate of the second PMOS transistor is coupled to a gate and a drain of the first PMOS transistor;

a second current mirror comprising:

a first NMOS transistor comprising a drain coupled to the drain of the first PMOS transistor; and a second NMOS transistor, wherein a drain of the second NMOS transistor is coupled to a gate of the first NMOS transistor, a gate of the second NMOS transistor, and a drain of the second PMOS transistor;

a first switch coupled between, and configured to equalize, the drain of the first PMOS transistor and the drain of the second PMOS transistor;

a second switch coupled between a source of the first NMOS transistor and an electrical ground;

a third switch coupled between a source of the second NMOS transistor and the electrical ground, wherein the second and the third switches are configured to operate with phases opposite to phases of the first switch; and a fourth switch coupled between the drain of the first PMOS transistor and the electrical ground.

2. The circuit of claim 1 further comprising an enablement signal node, wherein the first switch is opened in response to an enablement signal on the enablement signal node, and closed in response to a disablement signal on the enablement signal node, and wherein the second and the third switches are configured to be closed in response to the enablement signal, and opened in response to the disablement signal.

3. The circuit of claim 1 further comprising a pulse generator configured to generate a pulse in response to an enablement signal on an enablement signal node, and output the pulse to control the fourth switch, wherein the fourth switch is closed in response to the pulse.

4. The circuit of claim 3, wherein the pulse generator is configured not to generate any additional pulse until an additional disablement signal and an additional enablement signal are applied on the enablement signal node.

5. The circuit of claim 3, wherein the pulse generator is configured to end the pulse no later than a time the first and the second PMOS transistors are turned on.

6. The circuit of claim 1, wherein the first switch comprises a third PMOS transistor comprising a gate, and wherein each of the second and the third switches comprises a third NMOS transistor comprising a gate coupled to the gate of the third PMOS transistor.

7. The circuit of claim 1 further comprising a third PMOS transistor comprising a source coupled to a positive power supply node, a drain coupled to the gates of the first and the second PMOS transistors, and a gate coupled to switch control nodes of the first, the second, and the third switches.

8. A circuit comprising:

a first signal path comprising:

a first PMOS transistor;

a first NMOS transistor; and a first switch, wherein the first switch, a source-drain path of the first PMOS transistor, and a source-drain path of the first NMOS transistor are serially coupled between a positive power supply node and an electrical ground;

a second signal path comprising:

a second PMOS transistor;

a second NMOS transistor; and a second switch, wherein the second switch, a source-drain path of the second PMOS transistor, and a source-drain path of the second NMOS transistor are serially coupled between the positive power supply node and the electrical ground;

a third switch configured to interconnect gates of the first and the second PMOS transistors and gates of the first and the second NMOS transistors, and to disconnect the gates of the first and the second PMOS transistors from the gates of the first and the second NMOS transistors; and a fourth switch configured to interconnect the gates of the first and the second PMOS transistors to the electrical ground, and disconnect the gates of the first and the second PMOS transistors from the electrical ground.

9. The circuit of claim 8, wherein control nodes of the first, the second, the third, and the fourth switches are coupled to an enablement signal node.

10. The circuit of claim 8, wherein control nodes of the first, the second, and the third switches are directly connected with each other.

11. The circuit of claim 8, wherein the third switch comprises a PMOS transistor comprising a first source/drain region coupled to the gates of the first and the second PMOS transistors, and a second source/drain region coupled to the gates of the first and the second NMOS transistors.

12. The circuit of claim 11, wherein each of the first and the second switches comprises an NMOS transistor comprising a gate connected directly to the gate of the PMOS transistor of the third switch.

13. The circuit of claim 11 further comprising a pulse generator comprising an input coupled to the gate of the PMOS transistor of the third switch, and an output coupled to a control node of the fourth switch, and wherein the pulse generator is configured to generate a pulse to close the fourth switch, and open the fourth switch after the pulse is generated.

14. The circuit of claim 13, wherein the pulse generator comprises:

a plurality of serially coupled inverters having an odd count, wherein an input of the plurality of serially coupled inverters is connected to control nodes of the first, the second, and the third switches;

an NAND gate comprising a first input connected to the input of the plurality of serially coupled inverters, and a second input coupled to an output of the plurality of serially coupled inverters; and an inverter comprising an input coupled to an output of the NAND gate, and an output coupled to the control node of the fourth switch.

15. A method of generating bias voltages, the method comprising:

providing a bias circuit comprising:

a first PMOS transistor;

a second PMOS transistor, wherein a gate of the second PMOS transistor is coupled to a gate and a drain of the first PMOS transistor;

a first NMOS transistor comprising a drain coupled to the drain of the first PMOS transistor; and a second NMOS transistor, wherein a drain of the second NMOS transistor is coupled to a gate of the first NMOS transistor, a gate of the second NMOS transistor, and a drain of the second PMOS transistor;

in response to a disablement signal on an enablement signal node:

equalizing gate voltages of the first and the second PMOS transistors and gate voltages of the first and the second NMOS transistors to a positive power supply voltage; and disconnecting sources of the first and the second NMOS transistors from an electrical ground; and in response to an enablement signal on the enablement signal node:

disconnecting the gates of the first and the second PMOS transistors from the gates of the first and the second NMOS transistors; and connecting the sources of the first and the second NMOS transistors to the electrical ground.

16. The method of claim 15 further comprising:

in response to the enablement signal, coupling the gates of the first and the second PMOS transistors to the electrical ground; and at a time the first and the second PMOS transistors are turned on, decoupling the gates of the first and the second PMOS transistors from the electrical ground.

17. The method of claim 16, wherein after the step of coupling the gates of the first and the second PMOS transistors to the electrical ground, the gates of the first and the second PMOS transistors are decoupled from the electrical ground until an additional disablement signal and an additional enablement signal following the additional disablement signal are applied on the enablement signal node.

18. The method of claim 15, wherein the step of equalizing is performed by a PMOS transistor comprising a gate coupled to the enablement signal node, and wherein the step of connecting the sources of the first and the second NMOS transistors to the electrical ground, and the step of disconnecting the sources of the first and the second NMOS transistors from the electrical ground are performed by NMOS transistors.

19. The method of claim 15 further comprising:

outputting a first bias voltage from the gates of the first and the second PMOS transistors; and outputting a second bias voltage from the gates of the first and the second NMOS transistors.

* * * * *